US005564759A

United States Patent [19]

McNutt

[11] Patent Number: 5,564,759

[45] Date of Patent: Oct. 15, 1996

[54] PUSH-PULL LATCH MECHANISM

[75] Inventor: Arthur A. McNutt, Milton, Wis.

[73] Assignee: Hufcor, Inc., Janesville, Wis.

[21] Appl. No.: 158,619

[22] Filed: Nov. 29, 1993

[51] Int. Cl.[6] ..... E05C 1/06

[52] U.S. Cl. ..... 292/139; 292/336.3

[58] Field of Search ..... 292/139, 165, 292/168, 170, 336.3, DIG. 31, DIG. 37, DIG. 53

[56] References Cited

U.S. PATENT DOCUMENTS

| | | | |
|---|---|---|---|
| 1,490,777 | 8/1922 | LaFortune . | |
| 2,207,569 | 6/1939 | Wild | 292/169 |
| 2,504,483 | 4/1950 | Abraham | 292/174 |
| 3,036,850 | 5/1962 | Schmid | 292/244 |
| 3,490,803 | 1/1970 | Rollins | 292/170 |
| 3,655,230 | 4/1972 | Armstrong | 292/DIG. 53 X |
| 3,785,686 | 1/1974 | Armstrong | 292/336.3 |
| 4,007,954 | 2/1977 | Erickson | 292/165 |
| 4,629,228 | 12/1986 | Marko et al. | 292/165 |
| 4,986,583 | 1/1991 | Campbell et al. | 292/165 X |
| 5,085,474 | 2/1992 | Toledo | 292/336.3 X |
| 5,192,097 | 3/1993 | Su | 292/DIG. 31 X |

FOREIGN PATENT DOCUMENTS

| | | | |
|---|---|---|---|
| 2250371 | 5/1975 | France | 292/336.3 |

*Primary Examiner*—Steven N. Meyers
*Assistant Examiner*—Monica E. Millner
*Attorney, Agent, or Firm*—Michael, Best & Friedrich

[57] ABSTRACT

Disclosed herein is a latch mechanism which can be easily opened by disabled individuals. On one side of a door or panel is a knob which can be pushed to unlatch the door by urging a plunger from an extended position to a retracted position. Further pushing on the knob moves the door to an open position. On the other side of the door is a knob which can be pulled to unlatch the door. Further pulling on this knob moves the door to an open position. Each knob is substantially flush with the door so that the latch is not opened by accidental bumping, and so that, prior to installation, the door can be stacked with other like doors or panels for storage or transportation.

19 Claims, 3 Drawing Sheets

PUSH-PULL LATCH MECHANISM

FIELD OF THE INVENTION

The invention relates generally to door latching mechanisms and, more particularly, to door latching mechanisms that do not require a twisting action to unlatch.

BACKGROUND OF THE INVENTION

It is desirable to provide a door latch mechanism that is easily opened by handicapped individuals with a minimal amount of force and without any twisting action. This goal has been underscored by the Americans with Disabilities Act.

A latching device including a latching element which is selectively disengaged from a strike plate with a push or pull movement of respective handles is disclosed in U.S. Pat. No. 2,504,483, issued to Abraham et al. on Sep. 20, 1946.

SUMMARY OF THE INVENTION

The invention provides a latch mechanism which can be easily opened by disabled individuals. On one side of a door or panel is a knob which can be pushed to unlatch the door by urging a plunger from an extended position to a retracted position. Further pushing on the knob moves the door to an open position. On the other side of the door is a knob which can be pulled to unlatch the door. Further pulling on this knob moves the door to an open position.

Each knob is substantially flush with the door so that the latch is not opened by accidental bumping, and so that, prior to installation, the door can be stacked with other like doors or panels for storage or transportation.

A unidirectional engagement connection is provided between the push knob and the pull knob so that if someone is pulling the door shut from the push side, and someone is pulling the knob on the pull side, the movement of the pull knob will not cause movement of the push knob that could otherwise pinch the fingers of the person pulling on it.

The latch mechanism can be used for vertical latching, e.g., into a header above or the floor below.

The latch mechanism conforms to the requirements of the Americans with Disabilities Act in that no twisting action is required, and in that no more than five pounds of force is required to activate the latch.

Other features and advantages of the invention will become apparent to those of ordinary skill in the art upon review of the following detailed description, claims, and drawings.

DETAILED DESCRIPTION OF THE PREFERRED EMBODIMENT OF THE INVENTION

Shown in the various figures is a latch mechanism 10 for use with a door or panel 12 having first and second opposite apertured sides 14 and 16 and having an apertured edge 18 extending transversely between the sides.

Figure 1:
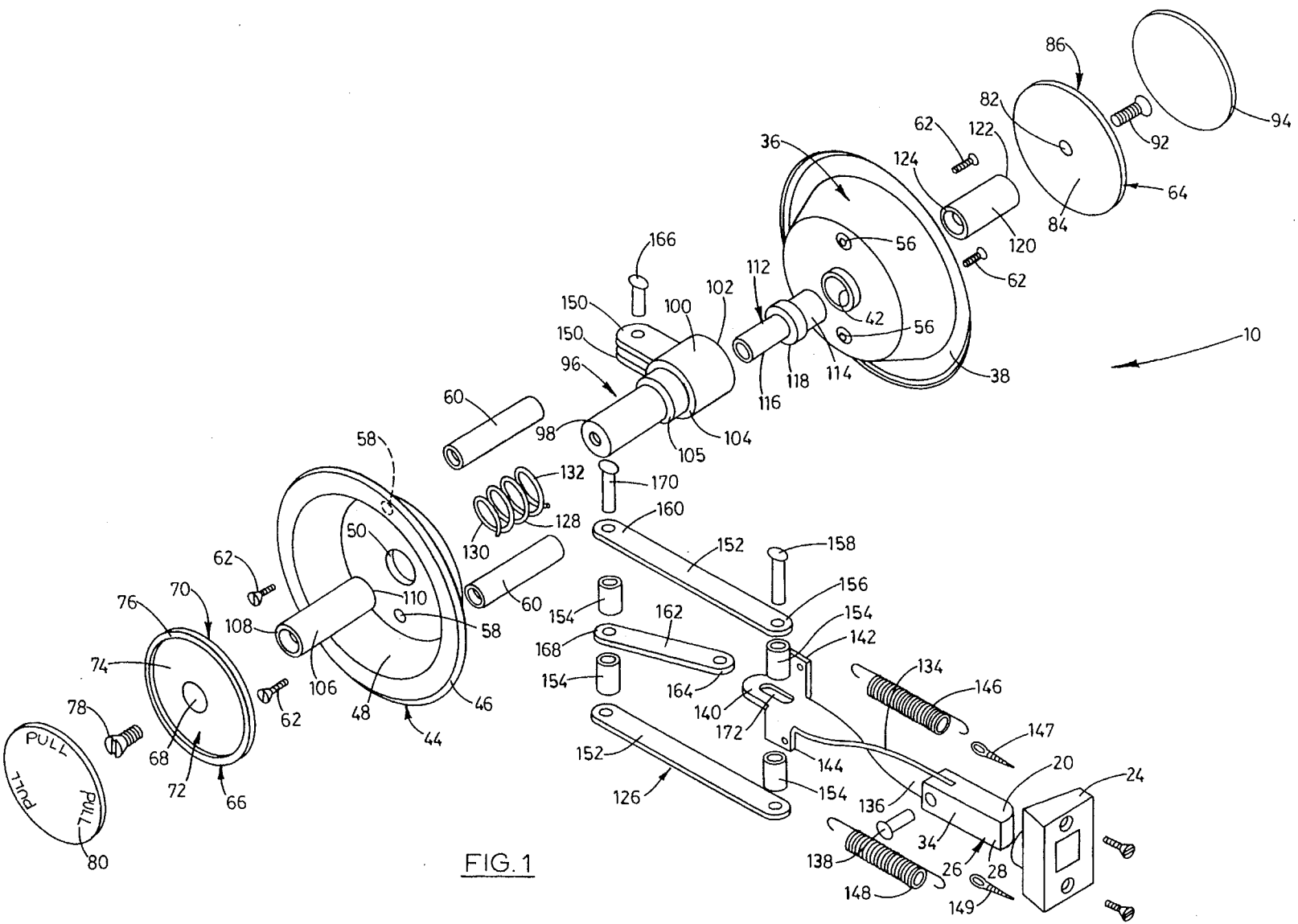
FIG. 1 is an exploded view, illustrating a latch mechanism embodying various features of the invention.
Figure 2:
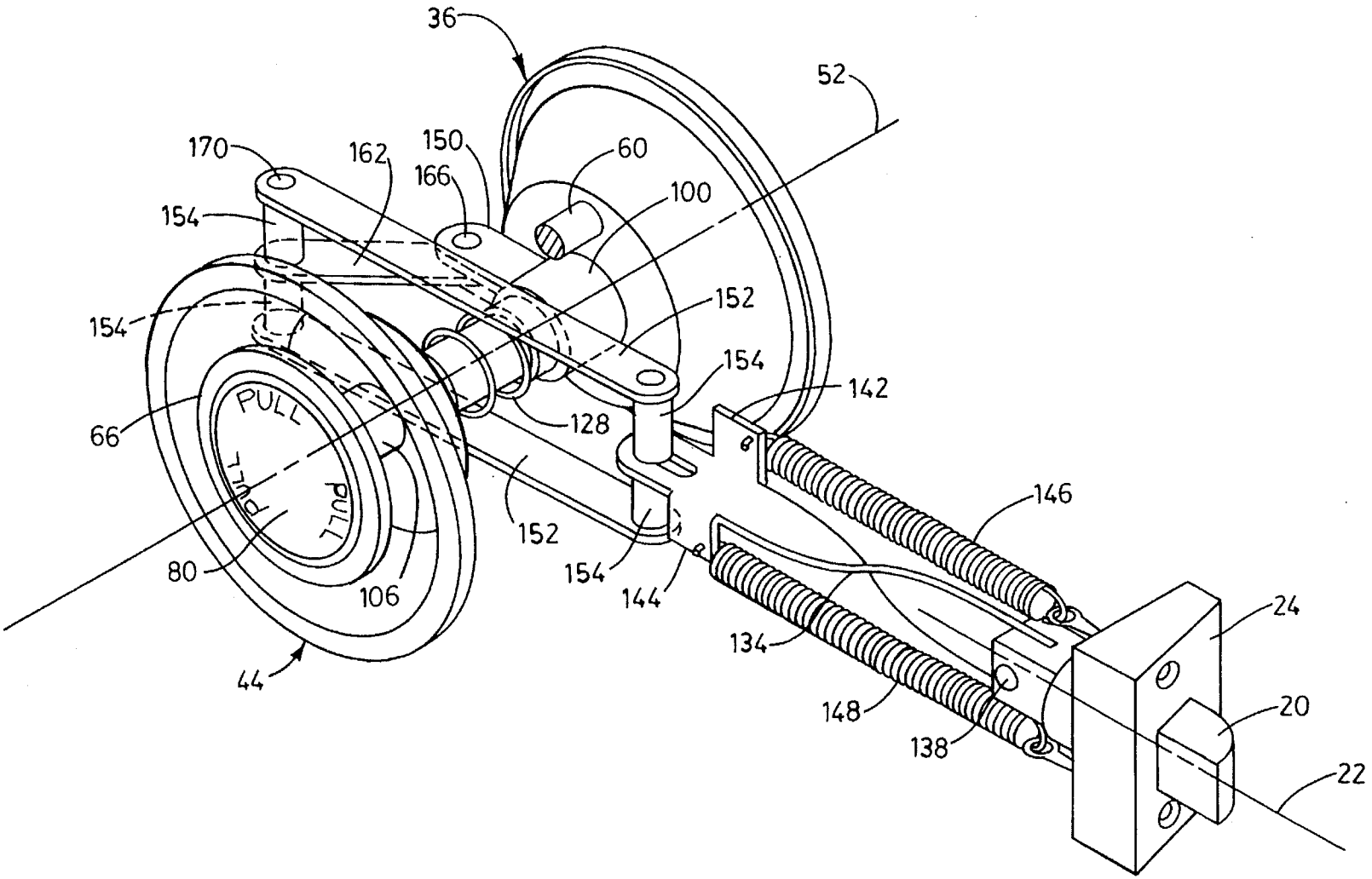
FIG. 2 is a perspective view illustrating the latch mechanism of FIG. 1 in assembled form.
Figure 3:
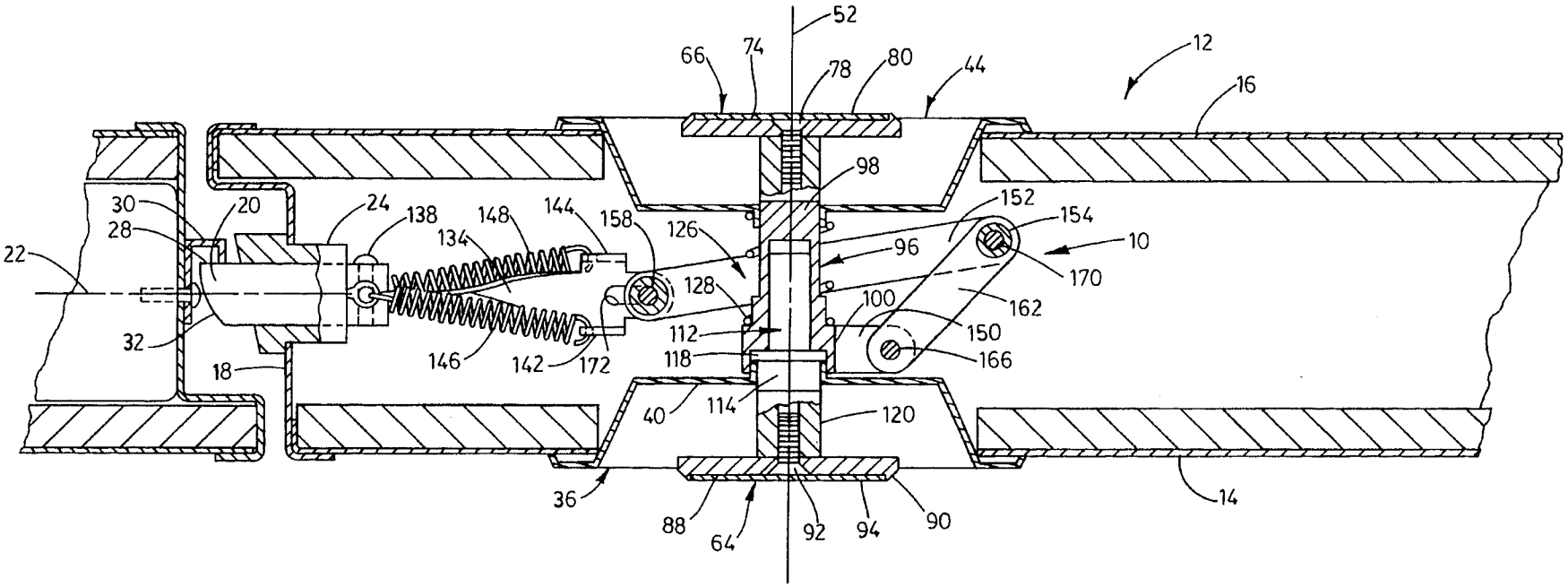
FIG. 3 is a top sectional view illustrating the latch mechanism of FIG. 1 assembled in a door.

The latch mechanism 10 includes a plunger 20 movable in the aperture through the edge 18 of the door, along a first axis 22, between an extended position (see FIG. 2) and a retracted position. More particularly, in the illustrated embodiment, the latch mechanism 10 includes a latch block 24 mounted in the aperture in the edge 18 of the door 12, which latch block 24 guides the plunger 20 between its extended and retracted positions. In the illustrated embodiment, the latch block 24 guides the plunger 20 in a manner which prevents rotation of the plunger 20 in the latch block 24. The plunger 20 has a first end extending out of the latch block 24 when the plunger 20 is in its extended position. The first end 26 of the plunger 20 has a first planar side 28, parallel to the second side 16 of the door 12, which engages a striker plate or angle plate 30 to latch the door 12 in a closed position. The first end 26 of the plunger also has a second arcuate side 32, opposite to and extending from the first planar side 28, which engages the striker plate 30 and allows the plunger 20 to move toward the retracted position, while the door 12 is being closed, until the door 12 is closed sufficiently for latching to take place. The plunger 20 further has an opposite end 34 (see FIG. 1).

The latch mechanism 10 includes a first escutcheon 36 on the first side 14 of the door, having a lip 38 engaging the first side 14 of the door, and having a concave portion 40 extending into the aperture in the first side 14 of the door to define a first recess extending from the lip 38 into the door 12. The escutcheon 36 has therethrough a central aperture 42.

The latch mechanism 10 further includes a second escutcheon 44 on the second side 16 of the door, having a lip 46 engaging the second side 16 of the door, and having a concave portion 48 extending into the aperture in the second side 16 of the door 12 to define a second recess extending from the lip 46 into the door. The second escutcheon has therethrough a central aperture 50 aligned with the central aperture 42 of the first escutcheon 36 along a push-pull axis 52 transverse to the first axis 22.

The latch mechanism 10 further including means, other than the door 12, for connecting the first escutcheon 36 to the second escutcheon 44 and for impeding movement of the first escutcheon 36 relative to the second escutcheon 44. In the illustrated embodiment, the first escutcheon 36 further has therethrough a pair of apertures 56 on opposite sides of the central aperture 42, the second escutcheon 44 further has therethrough a pair of apertures 58 on opposite sides of the central aperture 50 and respectively aligned with the spaced apart apertures 56 through the first escutcheon 36, and the escutcheon connecting means includes first and second cylindrical spacers 60, each spacer 60 extending between one of the pair of apertures 56 through the first escutcheon and one of the pair of apertures 58 through the second escutcheon 44. Each spacer 60 has opposite threaded ends. The escutcheon connecting means further includes screws 62 securing the escutcheons 36 and 44 to the cylindrical spacers 60 and thus securing the escutcheons 36 and 44 to each other.

The latch mechanism further includes a push knob 64 on the first side 14 of the door 12 and movable between a rest position, and a pushed in position which is closer to the aperture 42 in the first escutcheon 36 than the rest position, and a pull knob 66 on the second side 16 of the door and movable between a rest position, and a pulled out position which is farther from the aperture 50 in the second escutcheon 44 than the rest position of the pull knob 66.

In the illustrated embodiment, the pull knob 66 is a thin, disk shaped member having therethrough a central aperture 68, including a planar side 70 facing the door 12, and including a side 72 facing away from the door 12. The side 72 facing away from the door includes a recessed planar surface 74 surrounded by an annular ridge 76. The pull knob connecting means includes a screw 78 having a threaded portion passing through the central aperture 68 of the pull knob 66 and having a head portion engaging the side 72 facing away from the door 12. The latch mechanism 10 further includes a plate member 80 seated against the recessed planar surface 74, surrounded by the ridge 76, and covering the head of the screw 78. The plate member 80 may be secured to the recessed planar surface 74 by adhesive. The plate member 80 preferably has thereon the word "PULL" or an equivalent.

In the illustrated embodiment, the push knob 64 is identical to the pull knob 66, and includes a thin, disk shaped member having therethrough a central aperture 82, including a planar side 84 facing the door 12, and including a side 86 facing away from the door 12, the side facing away from the door 12 including a recessed planar surface 88 surrounded by an annular ridge 90. The push knob connecting means includes a screw 92 having a threaded portion passing through the central aperture 82 of the push knob 64 and having a head portion engaging the side 86 facing away from the door 12. The latch mechanism further includes a plate member 94 seated against the recessed planar surface 88, surrounded by the ridge 90, and covering the head of the screw 92. The plate member 94 may be secured to the recessed planar surface 88 by adhesive. The plate member 94 on the push knob preferably has thereon the word "PUSH" or an equivalent.

The latch mechanism further includes means for connecting the push knob 64 to the plunger 20, via the aperture 42 through the first escutcheon 36, such that the plunger 20 is moved from its extended position to its retracted position when the push knob 64 is moved from its rest position to its pushed in position, and means for connecting the pull knob 66 to the plunger 20, via the aperture 50 through the second escutcheon 44, such that the plunger 20 is moved to its retracted position from its extended position when the pull knob 66 is moved from its rest position to its pulled out position.

In the illustrated embodiment, the push knob 64 advantageously does not protrude substantially outwardly of the lip 38 of the first escutcheon 36 in a direction away from the aperture 42 through the first escutcheon 36. Similarly, the pull knob 66 does not protrude substantially outwardly of the lip 46 of the second escutcheon 44 in a direction away from the aperture 50 through the second escutcheon 44. Thus, the door 12, assembled with the latch mechanism 10, can be stacked with other like doors 12 during storage or transportation.

The pull knob connecting means and the push knob connecting means together include a first shaft member 96 movable along the push-pull axis 52 between a rest position and a displaced position. The shaft member 96 has a first end 98 connected to the pull knob 66, has a second opposite end 100 having therein a socket 102 extending along the push-pull axis 52 and facing the first escutcheon 36, and has a shoulder 104 between its first and second ends 98 and 100. The shaft member 96 further has a shoulder 105 between the shoulder 104 and the end 98. More particularly, in the illustrated embodiment, the latch mechanism 10 further includes a cylindrical bushing 106 which is guided by the aperture 50 in the second escutcheon 44 for movement along the push-pull axis 52. The bushing 106 has an end 110 that telescopically surrounds the first end 98 of the first shaft member 96 and that abuts the shoulder 105. The bushing 106 has an opposite end 108 which is engaged by the pull knob 66.

The pull knob connecting means and the push knob connecting means together further include a second shaft member 112 having a first end 114 connected to the push knob 64, having a second end 116 slidingly telescopically movable in the socket 102 along the push-pull axis 52, and having a shoulder 118 which engages the second end 100 of the first shaft member 96 to move the first shaft member 96 from its rest position to its displaced position when the push knob 64 is moved from its rest position to its pushed in position. More particularly, in the illustrated embodiment, the latch mechanism further includes a cylindrical bushing 120 which is guided by the aperture in the first escutcheon 36 for movement along the push-pull axis 52. The bushing 120 has an end 124 which telescopically surrounds the first end 114 of the second shaft member 112 and engages the shoulder 118. The bushing 120 has an opposite end 122 which engages the push knob 64. The central aperture 42 through the first escutcheon 36 will not permit passage of the shoulder 118 on the second shaft member 112, and the central aperture 50 through the second escutcheon 44 will not permit passage of the shoulder 104 on the first shaft member 96. Thus, the shoulder 118 on the second shaft member 112 and the shoulder 104 on the first shaft member 96 are always located between the first and second escutcheons 36 and 44.

The pull knob connecting means and the push knob connecting means together further include a lever mechanism 126 connected between the first shaft member 96 and the plunger 20 and moving the plunger 20 from its extended position to its retracted position in response to the first shaft member 96 moving from its rest position to its displaced position.

Movement of the pull knob 66 from its rest position to its pulled out position advantageously does not cause movement of the push knob 64 to its pushed in position. Thus, if someone is pulling the door 12 shut from the push knob side 14, and someone is pulling the knob 66 on the pull side 16, the movement of the pull knob 66 will not cause movement of the push knob 64 that could otherwise pinch the fingers of the person pulling on it.

The latch mechanism further includes means for biasing the pull knob 66 and the push knob 64 to their respective rest positions. In the illustrated embodiment, this means includes a spring 128 surrounding a portion of the first shaft member 96, having an end 130 engaging the second escutcheon 44, and having an opposite end 132 engaging the shoulder 104 on the first shaft member 96.

The latch mechanism further including means, other than the means for biasing the push and pull knobs 64 and 66, for biasing the plunger 20 to the extended position when the pull knob 66 and the push knob 64 are in their respective rest positions.

The opposite end of the plunger 20 is slotted along a plane which is perpendicular to the push-pull axis 52 and which plane includes the first axis 22. The lever mechanism 126 includes a follower member 134 oriented for movement along the first axis 22 and including a first planar end 136 housed in the slot in the plunger 20 and fastened to the plunger 20 by a rivet 138 for pivotal movement about an axis parallel to the push-pull axis 52, and a second planar end 140 perpendicular to the first planar end 136 and including opposite planar surfaces. The follower member 134 includes first and second tab members 142 and 144 respectively extending from the opposite planar surfaces of the second end 140 of the follower member 134, the first and second tab members 142 and 144 being spaced apart from each other in a direction parallel to the push-pull axis 52. The tab member 142 is spaced from the first axis by a distance equal to the distance at which the tab member 144 is spaced from the first axis.

The means for biasing the plunger 20 to the extended position includes a first spring 146 having a first end connected to the first tab member 142 and having an opposite end connected, via an eye screw 147, to the latch block 24 at a location along the plane defined by the slot in the plunger 20. The means for biasing the plunger 20 further includes a second spring 148 having a first end connected to the second tab member 144 and having an opposite end connected, via an eye screw 149, to the latch block 24 at a location along the plane defined by the slot in the plunger 20.

The first shaft further includes a pair of parallel spaced apart tabs 150 extending from the second end 100 of the first shaft 96 in a direction away from the plunger 20, and the lever mechanism further includes a pair of parallel arm members 152, spaced apart by spacers 154, having a first end 156 connected to the second end 140 of the follower member 134 by a fastener 158 for pivotal movement about an axis perpendicular to both the first axis 22 and the push-pull axis 52, and having a second end 160, such that the push-pull axis 52 is between the second end 160 of the arm members and the plunger 20 with regard to the direction of the push-pull axis 52. The fastener 158 can be a clevis pin and cotter circle type fastener, a rivet, or any other suitable fastener including providing for pivotal movement. The lever mechanism 10 further includes a link member 162 having a first end 164 connected to the tabs 150 on the first shaft by a rivet 166 for pivotal movement about an axis perpendicular to both the push-pull axis 52 and the first axis 22, and having a second end 168 connected to the second end 160 of the arm members 152, between spacers 154, by a fastener 170, for pivotal movement about an axis perpendicular to both the push-pull axis 52 and the first axis 22. The fastener 170 can be a clevis pin and cotter circle fastener, a rivet, or any other suitable fastener providing for pivotal movement. In the illustrated embodiment, the second escutcheon 44 provides a fulcrum for the lever mechanism 126 and is engaged by the arms 152 when the first shaft member 96 is moved from its rest position to its displaced position.

In the illustrated embodiment, the second end 140 of the follower member 134 includes a slot 172 that extends along the first axis 22, and the first end 156 of the arms 152 is pivotally connected to the second end 140 of the follower member 134 via the slot 172.

In operation, when the push knob 64 is pushed in, the second shaft member 112 moves toward the second escutcheon 44. This results in the shoulder 118 engaging the first shaft member 96 and moving the first shaft member 96 against the spring 128. The end 164 of the link member 162 is moved by the tab 150 on the first shaft member 96 in a direction parallel to the push-pull axis. The end 168 of the link member 162 moves the second end 160 of the arm members 152. The arm members 152 engage the second escutcheon 44 and, in a lever like manner, causes the plunger 20 to move from its extended position to its retracted position, against the bias of the springs 146 and 148. When the push knob 64 is released, the plunger 20 returns to its extended position (unless the second side 32 of the plunger encounters an obstacle), and the push knob 64 returns to its rest position, under the bias of the springs 146, 148, and 128.

In operation, when the pull knob 66 is pulled out, the first shaft member 96 moves toward the second escutcheon 44 against the spring 128. The end 164 of the link member 162 is moved by the tab 150 on the first shaft member 96 in a direction parallel to the push-pull axis. The end 168 of the link member 162 moves the second end 160 of the arm members 152. The arm members 152 engage the second escutcheon 44 and, in a lever like manner, causes the plunger 20 to move from its extended position to its retracted position, against the bias of the springs 146 and 148. Note that the second shaft member 112, and the push knob 64, are not required to move in response to movement of the first shaft member 96. When the pull knob 66 is released, the plunger 20 returns to its extended position (unless the second side 32 of the plunger encounters an obstacle), and the pull knob 66 returns to its rest position, under the bias of the springs 146, 148, and 128.

While a preferred embodiment of the invention has been described, various modifications are possible. For example, although the latch mechanism of the illustrated embodiment is shown mounted in a hollow door, the latch mechanism can also be employed in a solid door which has suitable hollowed areas. Various shaped knobs could be employed. Various means could be used to bias the plunger to an extended position which may include springs extending parallel to or perpendicular to the axis of movement of the plunger. Modifications may be made to the exemplary embodiment described and illustrated herein without departing from the spirit of the invention as expressed in the following claims.

I claim:

1. A latch mechanism for use with a door having a first side having therein a first aperture, a second side having therein a second aperture, and an edge extending transversely between the first and second sides, the edge having therein a third aperture, said mechanism comprising:

a plunger for movement in the third aperture along a first axis between an extended position and a retracted position, a first escutcheon having a lip for engaging the first side of the door and having a concave portion for being housed in said first aperture to define a first recess, said first escutcheon having therethrough an aperture, a second escutcheon having a lip for engaging the second side of the door and having a concave portion for being housed in said second aperture to define a second recess, said second escutcheon having therethrough an aperture, a push knob movable between a rest position and a pushed in position, said push knob being housed in said first recess such that said push knob is substantially flush with said lip of said first escutcheon when said push knob is in said rest position, a pull knob movable between a rest position and a pulled out position, said pull knob being housed in said second recess such that said pull knob is substantially flush with said lip of said second escutcheon when said pull knob is in said rest position, means for biasing said pull knob and said push knob to their respective rest positions, means for connecting said push knob to said plunger through said aperture of said first escutcheon such that said plunger is in said retracted position when said push knob is in said pushed in position, and means for connecting said pull knob to said plunger through said aperture of said second escutcheon such that said plunger is in said retracted position when said pull knob is in said pulled out position.

2. A latch mechanism as set forth in claim 1 and further comprising means for biasing said plunger to said extended position when said pull knob and said push knob are in their respective rest positions.

3. A latch mechanism as set forth in claim 1 and further comprising means for connecting said first escutcheon to said second escutcheon and for impeding movement of said first escutcheon relative to said second escutcheon.

4. A latch mechanism as set forth in claim 1 wherein movement of said pull knob from its rest position to its pulled out position does not cause movement of said push knob to its pushed in position.

5. A latch mechanism as set forth in claim 1 wherein said pull knob comprises a thin, disk shaped member.

6. A latch mechanism as set forth in claim 5 wherein said pull knob has therethrough a central aperture, includes a side facing the door including a planar surface, and a side facing away from the door, said side facing away from the door including a recessed planar surface surrounded by an annular ridge, wherein said pull knob connecting means comprises a screw having a threaded portion passing through said central aperture of said pull knob and having a head portion engaging said side facing away from the door, said latch mechanism further comprising a plate member seated against said recessed planar surface, surrounded by said ridge, and covering said screw head.

7. A latch mechanism as set forth in claim 6 wherein said push knob is substantially identical to said pull knob.

8. A latch mechanism as set forth in claim 2 wherein said aperture through said first escutcheon is aligned with said aperture through said second escutcheon along a push-pull axis transverse to the first axis, and wherein said pull knob connecting means and said push knob connecting means together comprise:

a first shaft member movable along the push-pull axis between a rest position and a displaced position, said first shaft member including a first end connected to said pull knob, and including a second opposite end having therein a socket extending along the push-pull axis and facing said first escutcheon, a lever mechanism connected between said shaft member and said plunger and moving said plunger from its extended position to its retracted position in response to said first shaft member moving from its rest position to its displaced position, and a second shaft member having a first end connected to said push knob, having a second end slidingly telescopically movable in said socket along the push-pull axis, and having a shoulder which engages said second end of said first shaft member to move said first shaft member from its rest position to its displaced position when said push knob is moved from its rest position to its pushed in position, whereby movement of said pull knob from its rest position to its pulled out position does not cause movement of said push knob to its pushed in position.

9. A latch mechanism as set forth in claim 8 wherein said aperture through said first escutcheon will not pass said shoulder on said second shaft member.

10. A latch mechanism as set forth in claim 9 wherein said first shaft member has a shoulder between its first and second ends, and wherein said means for biasing said pull knob and said push knob to their respective rest positions comprises a spring surrounding a portion of said first shaft member, having an end engaging said second escutcheon, and having an opposite end engaging said shoulder on said first shaft member.

11. A latch mechanism as set forth in claim 9 and further comprising a latch block adapted to be mounted in the third aperture in the edge of the door, said latch block guiding said plunger between its extended and retracted positions, said lever mechanism including a follower member attached to said plunger against movement relative to said plunger in a direction parallel to said push-pull axis, said means for biasing said plunger to said extended position comprising a spring having a first end connected to said follower member and having an opposite end connected to said latch block.

12. A latch mechanism as set forth in claim 9 and further comprising a latch block adapted to be mounted in the third aperture in the edge of the door, said latch block guiding said plunger between its extended and retracted positions, said plunger further having an end extending out of said latch block when said plunger is in its extended position and having an opposite end that is slotted along a plane which is perpendicular to the push-pull axis and which plane includes the first axis, said lever mechanism including a follower member oriented for movement along the first axis and including a first planar end housed in said slot in said plunger and fastened to said plunger for pivotal movement about an axis parallel to said push-pull axis, and a second planar end perpendicular to said first planar end and including opposite planar surfaces, said follower member including first and second tab members respectively extending from said opposite planar surfaces of said second end of said follower member, said first and second tab members being spaced apart in a direction parallel to said push-pull axis, said means for biasing said plunger to said extended position comprising a first spring having a first end connected to said first tab member and having an opposite end connected to said latch block at a location along the plane defined by said slot in said plunger and said means for biasing further comprising a second spring having a first end connected to said second tab member and having an opposite end connected to said latch block at a location along the plane defined by said slot in said plunger.

13. A latch mechanism as set forth in claim 8 wherein said first shaft member further comprises a tab extending from said second end of said first shaft member in a direction away from said plunger, and wherein said lever mechanism further comprises:

a follower member including a first end attached to said plunger against movement relative to said plunger in a direction parallel to said push-pull axis, and including a second end, an arm member having a first end connected to said second end of said follower member for pivotal movement about an axis perpendicular to both said first axis and said push-pull axis, and having a second end, said push-pull axis being between said second end of said arm member and said plunger with regard to the direction of said push-pull axis, and a link member having a first end connected to said tab on said first shaft member for pivotal movement about an axis perpendicular to both said push-pull axis and said first axis, and having a second end connected to said second end of said arm member for pivotal movement about an axis perpendicular to both said push-pull axis and said first axis, wherein said second escutcheon provides a fulcrum for said lever mechanism and is engaged by said arm when said first shaft member is moved from its rest position to its displaced position.

14. A latch mechanism as set forth in claim 13 wherein said second end of said follower member includes a slot that extends along the first axis, and wherein said first end of said arm is pivotally connected to said second end of said follower member through said slot in said follower member.

15. A latch mechanism for use with a door having first and second sides each having an aperture therein and having an edge extending transversely between the sides, the edge having therein an aperture, said mechanism comprising:

a plunger for movement in the aperture in the edge of the door, along a first axis, between an extended position and a retracted position, a push member for engaging the first side of the door movable between a rest position and a pushed in position, a pull member for engaging the second side of the door movable between a rest position and a pulled out position, said push knob and said pull knob being aligned along a push-pull axis transverse to said first axis, a first shaft member movable along said push-pull axis between a rest position and a displaced position, said first shaft member including a first end connected to said pull member and including a second opposite end having therein a socket extending along the push-pull axis and facing said push-member, a lever mechanism connecting said first shaft member and said plunger and moving said plunger from its extended position to its retracted position in response to said first shaft member moving from its rest position to its displaced position, a second shaft member having a first end connected to said push member, having a second end slidingly telescopically in said socket along said push-pull axis, and having a shoulder which engages said second end of said first shaft member to move said first shaft member from its rest position to its displaced position when said push member is moved from its rest position to its pushed in position, and means for biasing said plunger to said extended position when said pull member and said push member are in their respective rest positions.

16. A latch mechanism as set forth in claim 15 and further comprising means for biasing said pull member and said push member to their respective rest positions.

17. A push-pull door latch mechanism for use with a door having first and second opposite side surfaces each having therein an aperture and having an edge surface between said first and second side surfaces, the end surface having therein an aperture, said mechanism comprising:

a first escutcheon for being housed in the aperture of the first surface of the door, said first escutcheon having therethrough an aperture and defining a first recess;

a second escutcheon for being housed in the aperture of the second surface of the door, said second escutcheon having therethrough an aperture that is aligned with said aperture of said first escutcheon along a push-pull axis, said second escutcheon defining a second recess;

a push knob housed in said first recess and movable between a rest position and a pushed in position such that said push knob is substantially flush with said first escutcheon when said push knob is in said rest position;

a pull knob housed in said second recess and movable between a rest position and a pulled out position such that said pull knob is substantially flush with said second escutcheon when said pull knob is in said rest position;

a first shaft member movable along said push-pull axis between a rest position and a displaced position, said first shaft member including a first end connected to said pull knob and a second end having therein a socket;

a plunger movable in the aperture in the edge surface of the door between an extended position and a retracted position;

a lever mechanism between said first shaft member and said plunger, said lever mechanism moving said plunger from its extended position to its retracted position in response to said first shaft member moving from its rest position to its displaced position; and a second shaft member having a first end connected to said push knob, a second end movable in said socket of said first shaft member and a shoulder which engages said second end of said first shaft member to move said first shaft member from its rest position to its displaced position when said push knob is moved from its rest position to its pushed in position whereby movement of said pull knob from its rest position to its pulled out position does not cause movement of said push knob to its pushed in position.

18. A push-pull door latch mechanism as set forth in claim 17 and further including a latch block mounted in the aperture in the edge surface of the door, said latch block guiding said plunger between its extended and retracted positions.

19. A push-pull door latch mechanism as set forth in claim 17 wherein said first and second escutcheons each include a tapering concave portion that is housed in the respective first and second recesses and each include an annular lip portion attached to said tapering concave portion, each of said lip portions abut the respective first and second surfaces of the door.

* * * * *